United States Patent [19]

Lane, Jr.

[11] Patent Number: 4,854,466

[45] Date of Patent: Aug. 8, 1989

[54] HANGING PACKAGING CUP

[76] Inventor: William A. Lane, Jr., P.O. Box 2345, Lake Arrowhead, Calif. 92352

[21] Appl. No.: 155,563

[22] Filed: Feb. 12, 1988

[51] Int. Cl.[4] ..... B65D 17/28; B65B 61/14

[52] U.S. Cl. ..... 220/23.83; 53/410; 53/413; 53/471; 220/23.4; 220/23.86; 220/83; 248/311.2; 426/115

[58] Field of Search ..... 220/23.83, 23.86, 23.4, 220/83, 94 B; 229/1.5 B, 125.35, 1.5 R; 426/115, 120; 248/311.2, 312.1, 314, 360; 53/410, 413, 453, 471

[56] References Cited

U.S. PATENT DOCUMENTS

| | | | |
|---|---|---|---|
| 300,830 | 6/1884 | Arnold | 220/23.83 X |
| 2,149,713 | 3/1939 | Webber | 53/413 X |
| 2,526,602 | 10/1950 | Crumrine | 220/23.83 X |
| 2,597,468 | 5/1952 | Garrett | 220/23.83 X |
| 2,705,579 | 4/1955 | Mason | 53/453 X |
| 2,979,301 | 4/1961 | Reveal | 248/311.2 X |
| 3,021,001 | 2/1962 | Donofrio | 220/23.4 X |
| 3,069,273 | 12/1962 | Wayne | 53/471 X |
| 3,442,435 | 5/1969 | Ludder et al. | 426/115 X |
| 3,660,960 | 5/1972 | Inman | 53/471 X |

*Primary Examiner*—Harvey C. Hornsby
*Assistant Examiner*—Stephen F. Gerrity
*Attorney, Agent, or Firm*—Herb Boswell

[57] ABSTRACT

A packaging cup of the type typically utilized to contain a small volume of a condiment and formed of a resilient material which has a reservoir and a lip which surrounds the reservoir with a lid sealed to the lip is improved by including support fingers formed in the lip. The support fingers are formed by including slits in the lip which separate segments of the lip into the support fingers. Each of these segments, however, is maintained to the lip by a connectable portion. The support fingers are bendable about the connecting portion allowing positioning of the support fingers out the plane of the lip. When positioned out of the plane of the lip the support fingers can be engaged over a surface as, for instance, the vertical wall of another container to hold the packaging cup on the vertical wall of the container.

19 Claims, 3 Drawing Sheets

HANGING PACKAGING CUP

BACKGROUND OF INVENTION

This invention is directed to a packaging cup which includes one or more support fingers formed in the lip of the cup for supporting the cup on a further object as, for instance, a food product container.

For use in the fast food and other industries, packaging cups have been developed for containing individual servings of condiments or other food products. These cups allow for dispensing of premeasured and protected amounts of condiments such as catsup, mustard, hot sauce, salad dressing and the like.

The above referred to packaging cups include a cup body, which is normally vacuum formed out of a resilient material as, for instance, polyethylene. The cup body has a reservoir for holding a volume of the food stuff or the like and a lip or flange which extends completely around the reservoir. A lid is sealed over the cup by sealing the lid to the lip. Since the lip extends completely around the reservoir, securing the lid to the lip seals the lid over the top of the reservoir. The cup is opened by peeling the lid back from the lip to expose the reservoir and the contents therein.

Typical of the above referred to packaging cups are packaging cups utilized to hold catsup as a garnish for french fries. Normally certain food items such as french fries and the like are served to a patron in a small container as, for instance, a light cardboard container. These containers are self supporting such that the container of french fries can be placed on a table or held in ones hand. If the patron is sitting at a table while eating the french fries it is very convenient for the patron to set the catsup condiment cup also on the table and individually dip the french fries in the condiment cup.

At other times, however, the patron consumes the french fries or other food stuff while walking, standing or sitting where a table is not available. To consume the product as, for instance french fries, the patron must hold the french fry container in one hand and utilizes the other hand to convey the french fry or other food product to the patron's mouth. This thus leaves no hands free for holding the condiment cup. The patron must either attempt to hold both the food container and the condiment cup in one hand and utilize the other hand to feed themselves or to hold the food container in one hand and the condiment cup in the other and attempt to then manipulate the food item while holding both of these containers. Needless to say, this is an awkward situation and sometimes leads to spilling of one or the other of the food container or the condiment cup.

BRIEF DESCRIPTION OF THE INVENTION

In view of the above it is evident that there exists a need for new and improved packaging cups for holding condiments and the like wherein the packaging cup is capable of being suspended from a further package container such that a user can hold both the container and the condiment cup in one hand and utilize the other hand to feed themselves. It is a broad object of this invention to provide such new and improved packaging cups.

It is a further object of this invention to provide for hanging or suspendable packaging cups which are easily utilized by the consumer, yet are still economically produced.

These and other objects as will become evident from the remainder of this specification are achieved in a hanging packaging cup which includes a resilient body having a product reservoir and a lip integrally formed together. The reservoir has a periphery which surrounds an opening into the reservoir. The lip is formed as a continuous essentially planar flange extending around the totality of the periphery of the reservoir. A lid for sealing the reservoir by covering the reservoir opening is sealed to the lip around the totality of the periphery of the reservoir. At least a portion of the lip is formed as a first support finger. A portion of this support finger is disjoined from the lip along at least one elongated slit between the lip and the support finger and a remaining portion of this support finger is joined to the lip along a connecting area between the support finger and the lip. The support finger is bendable with respect to the lip about the connecting area allowing the support finger to be located at an angle to the plane of the lip.

Advantageously first and second support fingers can be formed as independent portions of the lip. Each of the first and the second support fingers are independently bendable at an angle to the plane of the lip.

Advantageously the first and second support fingers can be located in several orientations with respect to one another. In a first of these orientations they are located on the cup such that when they are bent from the plane of the lip, i.e. they are located at respective angles to the plane of the lip, they are positioned on the same side of the cup. In a further orientation they are formed in positions on the lip of the cup such that when they are bent from the plane of the lip, i.e. they are located at respective angles to the plane of the lip, they are located in a plane which intercepts the plane of the lip.

In one embodiment of the invention the outside periphery of the lip of the cup is quadrilaterally shaped and the slit for any support finger is formed essentially parallel to one of the sides of the quadrilateral. In a quadrilaterally shaped cup first and second support fingers can be independently formed by colinear slits. Further, first and second fingers can be independently formed by parallel slits. Additionally, first and second fingers can be formed by a single elongated slit and by a further slit which is located perpendicular to the single elongated slit. In a further embodiment of a packaging cup which is round or oval, first and second support fingers can be independently formed by independent coarcuate slits.

The support fingers can be considered as support means which are defined in the lip by slits which can be considered as separation means. The slits disjoin portions of the lip forming the support fingers however a connectable area is still retained between the lip and each support finger to provide a hinge between the support finger and the lip. The support finger is flexible or movable with respect to the lip about the connecting area or hinge.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the packaging arts will realize that these principles and/or concepts are capable of being expressed in a variety of embodiments which may differ from the exact embodiments utilized for illustrative purposes herein. For this reason this invention is not to be construed as being limited to the illustrative embodiments, but should only be construed in view of the claims.

DETAILED DESCRIPTION OF THE INVENTION

Condiments are served with many fast food items as, for instance, serving catsup with french fries and certain sauces with chicken nuggets, eggrolls and the like. One ideal packaging method for dispensing individual portions of these condiment items is in sealed containers hereinafter referred to as packaging cups. These packaging cups have a reservoir for the cups contents which is integrally formed with a lip which surrounds the opening to the reservoir. A lid is sealed to the cup to preserve the contents therein by sealing the lid to the lip which surrounds the opening in the reservoir. To utilize the contents of the cup, the lid is peeled back exposing the opening to the reservoir and the contents therein.

Figure 1:
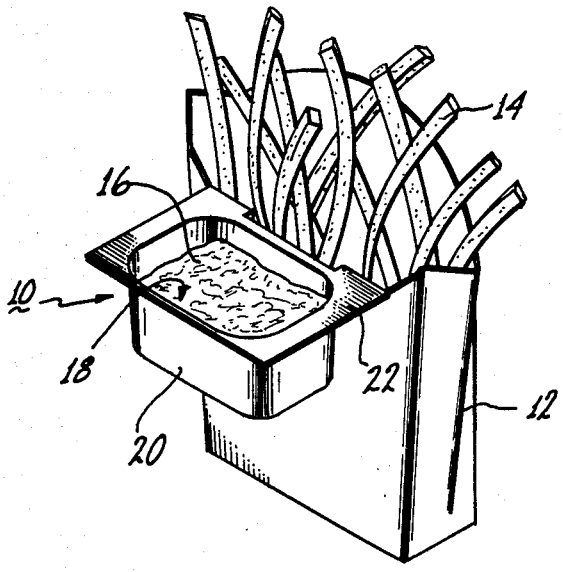
FIG. 1 is an isometric view showing a french fry container and a hanging packaging condiment cup of the invention with the hanging cup shown attached to the french fry container.

In FIG. 1 an improved packaging cup 10 of the invention is shown as it is utilized in conjunction with a container 12 containing as, for instance, french fries depicted by the numeral 14. A quantity of catsup 16 is exposed through an opening 18 in a reservoir 20 of the cup 10. Surrounding the opening 18 of the reservoir 20 of the cup 10 is the cup lip 22. The lip 22 extends completely around the reservoir 20.

Cups 10 of the invention as are further illustrated in FIGS. 2, 3 and 4 includes a plurality of support fingers (hereinafter separately numbered and identified) which allows for suspending or hanging of the cups 10 on the container 12. From FIG. 1 it is evident that when a consumer of the french fries 14 holds the container 12 the consumer is simultaneously also supporting the condiment packaging cup 10.

The lip 22 of the cup 10 is formed as a flange which extends outwardly in a plane from the reservoir 20. Normally the packaging cup 10 is formed of a resilient semi-bendable material as, for instance, polyethylene sheet. As will be described below in greater detail, a sheet of polyethylene is vacuum formed or otherwise formed to form a matrix of joined packaging cups. These are then filled, sealed and separated from one another to form the individual cups 10.

Figure 2:
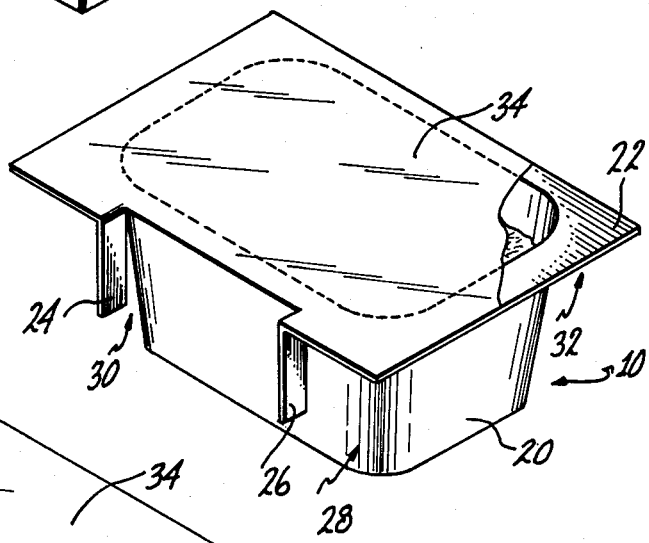
FIG. 2 is an isometric view of a first embodiment of support fingers for a hanging cup of the invention.

In FIG. 2 a first orientation of the packaging cup 10 is seen. In this orientation support fingers 24 and 26 are formed on one side of the lip 22 and can be bent downwardly out of the plane of the lip 22 such that they are located essentially parallel to the outside surface 28 of the reservoir 22. This forms a gap 30 between the respective support fingers 24 and 26 and the outside surface 28.

The packaging cup 10 can now be hung or suspended on a suitable surface as, for instance, the side of the container 12 by positioning or interleaving the side of the container 12 in the gap 30 between the outside surface 28 of the reservoir 20 and the support fingers 24 and 26. The underneath surface 32 of the lip 22 rests on an upper surface of one of the walls of the container 12 and is maintained in this position by the support fingers 24 and 26 being on one side of the surface of the container 12 as, for instance the inside surface of the container 12 seen in FIG. 1, and the outside surface 28 of the reservoir 20 being on the other side of the surface of the container as, for instance the outside of the container 12 of FIG. 1.

Further, in FIG. 2 a lid 34 of the container 12 is seen. The lid 34 is sealed to the lip 22 using a heat seal or the like. Since the lip 22 completely surrounds the reservoir 20 when the lid 34 is sealed to the lip 22, this seals the reservoir 20. Normally the lid 34 is formed of a foil or a foil laminated with a thermoplastic material such that it can be easily peeled off of the packaging cup 10, yet will remain sealed to the lip 22 until it is desirable to utilize the contents of the packaging cup 10.

Figure 3:
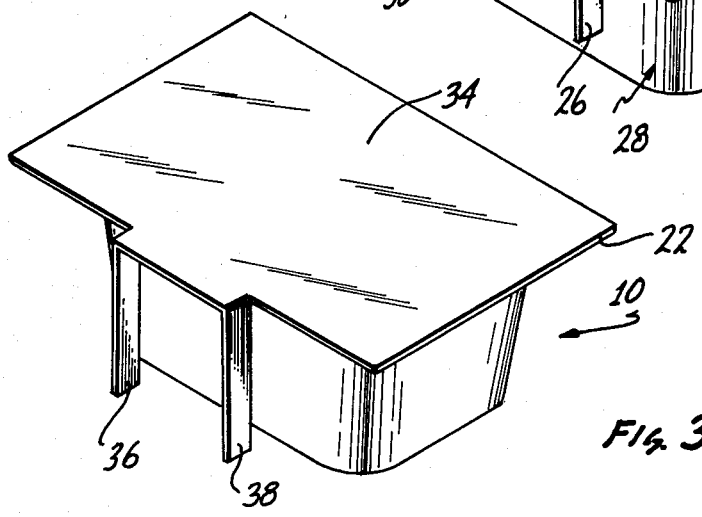
FIG. 3 is an isometric view of an second embodiment of support fingers for a hanging cup of the invention.

FIG. 3 shows a further orientation of support fingers 36 and 38 on a packaging cup 10. As with the embodiment of FIG. 2, in the embodiment of FIG. 3 the support fingers 36 and 38 are both formed from the material along one side of the lip 22 of the packaging cup 10.

Figure 4:
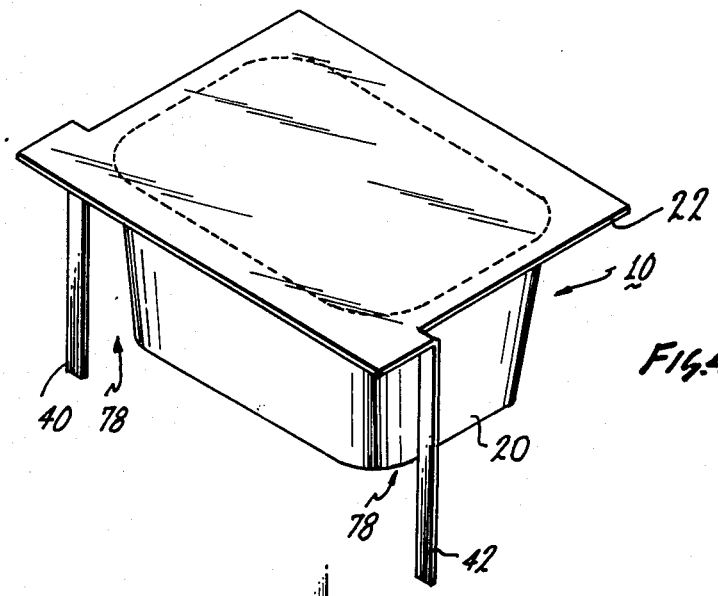
FIG. 4 is an isometric view of a further embodiment of support fingers for a hanging cup of the invention.

FIG. 4 shows a further embodiment of the invention wherein support fingers 40 and 42 are formed on opposing sides of the lip 22 of the packaging cup 10. In each of the FIGS. 2, 3 and 4 the packaging cup 10 is essentially formed as a quadrilateral. As illustrated this quadrilateral is formed as a rectangle; however, packaging cups 10 having square configurations can just as easily be formed. In addition, round or oval orientations are also utilized for packaging cups. The principles of the invention can also be adapted to such round or oval packaging cups 10.

In FIGS. 2, 3 and 4, the respective support fingers of those Figures have been bent downwardly out of the plane of the lip 22 into a position wherein they can be utilized to support the packaging cup 10 of a suitable support surface as, for instance the container 12. In FIG. 7 the tops of several packaging cups of the invention are illustrated with the support fingers still in the plane of the lip 22 prior to bending them out of the plane of the lip.

Figure 7C:
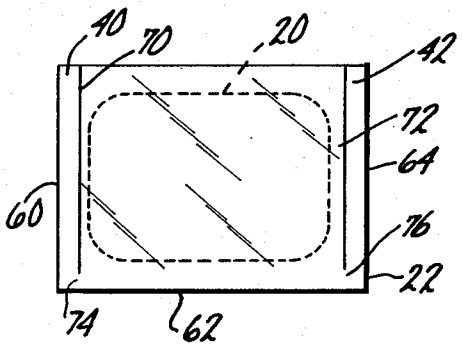
FIG. 7 is a plan view showing several different orientations of support fingers on packaging cups of the invention.
Figure 7D:
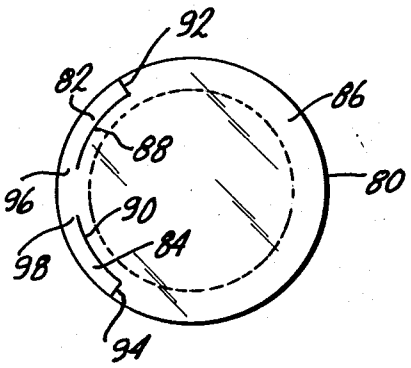
Figure 7A:
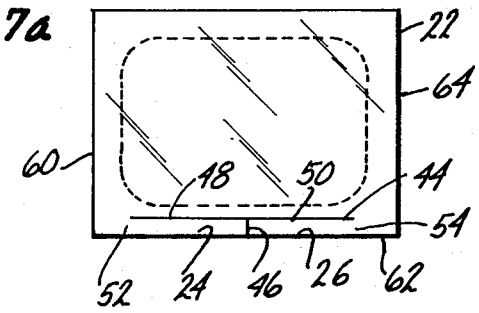

In FIG. 7*a* the top of the packaging cup 10 of FIG. 2 is shown prior to bending of the supporting fingers 24 and 26 out of the plane of the lip 22. As is evident from FIG. 7*a*, the support fingers 24 and 26 are formed by forming an elongated slit 44 on one side of the lip 22 with a further slit 46 located perpendicular to and intersecting the elongated slit 44. This divides the slit 44 into a first slit 48 and second slit 50. Both of the slits 44 and 46 go completely through the lip 22 from its upper surface to its underneath surface. This defines the fingers 24 and 26 with the finger 24 remaining joined to the lip 22 via connecting area 52 and the finger 26 remaining joined to the lip 22 via connecting area 54.

Either the user, the dispensor or the packager of the hanging cup 10 of FIG. 7*a* bends the fingers 24 and 26 out of the plane of the lip 22 such that they extend downwardly at angles with respect to the plane of the lip 22. This positions each of the support fingers 24 and 26 on a single side of the hanging cup 10.

Figure 7B:
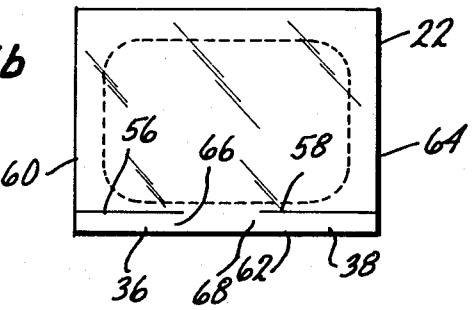

FIG. 7*b* shows a top plan view of the embodiment of the hanging cups in FIG. 3. To form the support fingers 36 and 38 first and second colinear slits 56 and 58 are made in the lip 22. The slit 56 is formed from the left hand edge 60 of the lip 22 parallel to the elongated edge 62. The slit 58 is formed from the right hand edge 64 also parallel to the elongated edge 62. The two slits 56 and 58 extend toward one another but do not join such that connective areas 66 and 68 remain between the support fingers 36 and 38 and the lip 22.

FIG. 7*c* shows a top plan view of the embodiment of the hanging cup seen in FIG. 4. For formation of the support fingers 40 and 42 on the lip 22, elongated slots 70 and 72 are formed parallel to each other in the lip 22 on opposite sides of the reservoir 20. When the support fingers 40 and 42, however, are bent out of the plane of the lip 22, by bending about their connecting areas 74 and 76, they become located in an imaginary plane which passes through them and intersects the plane of the lip 22. Additionally, however they become located in association with the elongated side 62 and in the same way as the gap 30 was formed in the embodiment of FIG. 2, a gap 78 is formed in the embodiment of FIGS. 4, and 7*c*.

FIG. 7*d* illustrates a round packaging cup 80 having arcuate shaped support fingers 82 and 84. These are formed in the round lip 86 by arcuate slits 88 and 90 which are intersected by radial slits 92 and 94. The fingers 82 and 84 remain joined to the body of the lip 80 at connecting areas 96 and 98. The support fingers 82 and 84 are bent out of the plane of the lip 80 about the connecting areas 96 and 98.

In each of the cups 10 or 80 shown in FIG. 7 (with the exception of slit 46) the slits which define the support fingers extend from a position on the respective cups lips along a line which is spaced from and follows the configuration of the periphery (the shape of the outside of the lip) of the cup. Thus for instances slits 48 and 50 of FIG. 7*a* and slits 56 and 58 of FIG. 7*b* are spaced from and follow the straight configuration of the edge 62. The slits 70 and 72 of FIG. 7*c* are spaced from and follow the straight configuration of edges 60 and 64 and the slits 88 and 90 of FIG. 7*d* are spaced from and follow the configuration of round outside edge of the cup 80.

The slits 48 and 50 extend from a position on the edge 62 (a position on the periphery of the cup 10) along slit 46. In a like manner the slits 88 and 90 entend from the periphery of the cup 80 radially along slits 92 and 94. The slits 56 and 58 and 70 and 72 directly connect to the periphery of their respective cups.

While not shown in the figures, a slit could extend from the periphery of the same edge whose configuration it followed. Thus as, for instance, slit 70 could have started directly from edge 60 and slit 72 could have started directly from edge 64. After extending a short distance from the periphery these slits would curve or bend at an angle and then for the remainder of the distance of the slit, it would exactly follow the configuration of the periphery of the cup. This would result in pointed ends being formed on the respective support finger defined by such slits. In each of the embodiments which are illustrated in the figures, the ends of the respective support fingers are square. It is evident that round or even a further shaped could be acheived by making an appropriate shaped slit in the lips to define the finger shape.

Figure 5:
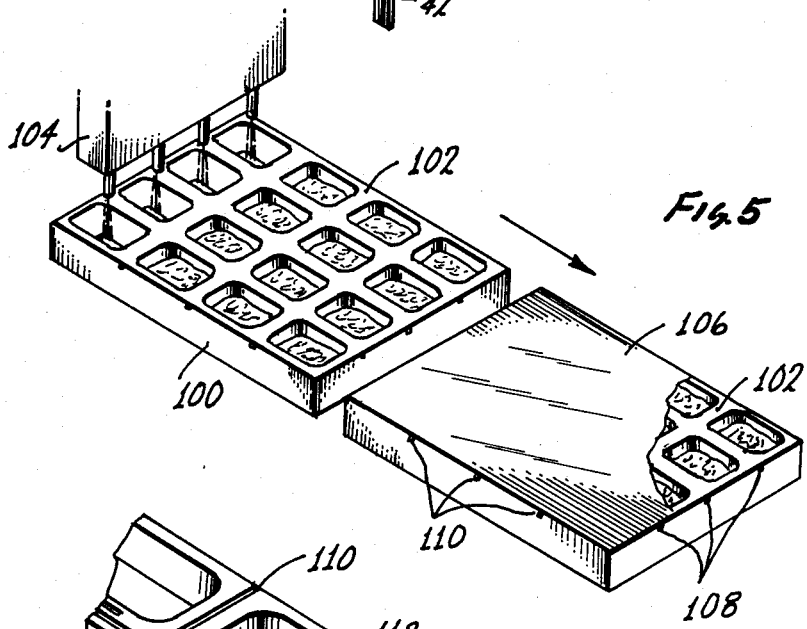
FIG. 5 is a an isometric view showing the progression of bank or matrix of packaging cups being filled, sealed and die cut on a packaging machine.
Figure 6:
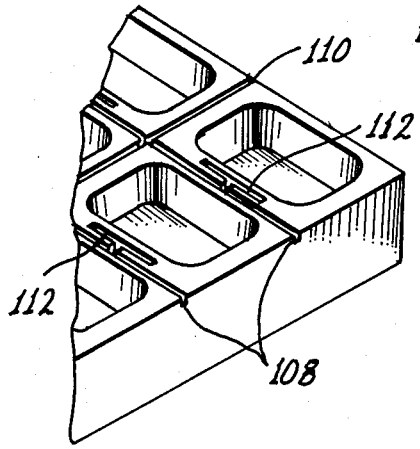
FIG. 6 is a fragmentary isometric view of a conveyor element of the packaging machine utilized in FIG. 5.

Referring now to FIGS. 5 and 6, a packaging machine utilized to form the packaging cups 10 (or the packaging cup 80) has a conveyor belt having a series of support plates 100 linked together to form a continuous belt. A preformed as, for instance a vacuum formed matrix of connected packaging cups 102, is positioned in one of the support plates 100 and the individual cups are then filled with a condiment or other material by a fill head 104.

A lid material 106 is sealed to the matrix 102 of the individual cups and then a die or other cutting mechanism as, for instance a plurality of cutting knives, is utilized to separate the individual packaging cups 10 from the matrix 102.

As is seen in FIG. 6 in a fragmentary close up view of the support plate 100, the support plate 100 has a plurality of channels formed therein. These channels include longitudinal channels 108 which go along the length of the support plate 100 in the direction of movement of the plate 100 and cross channels 110 which are perpendicular to the longitudinal channels 108.

The support plate 100 illustrated in FIG. 6 would be utilized to make the embodiment of the packaging cup 10 which is illustrated in FIGS. 2 and 7*a*. Thus, in addition to the channels 108 and 110, the support plate 100 would include T channels 112 located adjacent to the longitudinal channels 108.

After the matrix of connected packaging cups has been filled and lid 106 heat sealed to the top thereof, further movement along the length of the packaging machine positions the support plate 100 either underneath a plurality of cutting knives or under a cutting die. These engage a respective channels 108, 110 and 112 to separate the individual packaging cups 10 from one another and to form the appropriate slits necessary to define the support fingers of the packaging cups 10. The packaging cups 10 are then removed from the support plate 100. They can be packaged with the fingers being maintained in the plane of the lip 22 or further machinery can bend the support fingers out of the plane of the lip 22. It is preferred, however, simply to ship the individual closed packaging cups 10 with the support fingers in the plane of the lip 22 and have either the employee which is dispensing the product or the user thereof, bend the support fingers out of the plane of the lip 22 for attachment to an appropriate container as, for instance, the container 12.

When the slits defining the support fingers are concurrently formed in both the material which forms the lip 22 and the lid 24 as, for instance by an appropriate die and when the support fingers are bent downwardly out of the plane of the lip 22 and the lid 34 is removed, the lid 34 tears along the connecting areas connecting the support fingers to the lip 22 such that the lid is removed over the opening of the reservoir, however, it does not distort or bend the support fingers.

While for the purposes of illustration above, the slits which define the support fingers were formed concurrently with the slits which separate the individual packaging cups from one another in the matrix of packaging cups. Alternately, the slits which define the support fingers could be formed in the matrix of the packaging cups prior to filling and sealing. After being filled and sealed, the individual cups would then be seperated from each other in a normal manner. As so formed, while the respective individual cups are separated from one another, the lid material of each individual cup would still be over the area of the slits in that individual cup which define the support fingers of the respective cup. Since the lid material is a thin foil or foil and plastic laminate, it would serve to fix the support fingers in the plane of the lip 12 until such time as the support fingers were bent out of the plane of the lip 22. In bending the supporting fingers out of the plane of the lip 22, the lid material would easily tear along the preformed slits which define the support fingers.

In addition to forming the cups 10 and 80 of the invention out of polyethylene other materials can also be utilized. The criteria for selecting a suitable material is that the material must be amendable to being formed into the cup and after being formed it must hold it shaped. Further the material must be such that the fingers (and of course the lip) must be stiff enough to retain their shaped but at the same time must be bendable such that the fingers can be bent out of the plane of the lip from which they are formed.

In addition to polyethylene other suitable materials which meet the above materials criteria can be selected from polypropylene, polystyrene, thick metal foils, a material known in the packaging industry as "ovenable board" and the like.

What is claimed is:

1. A hanging packaging cup which comprises:

a resilient body having a product reservoir and a lip integrally formed together, said reservoir having a periphery surrounding an opening into said reservoir and said lip formed as a continuous essentially planar flange extending from the periphery of said reservoir;

a lid for sealing said reservoir, said lid covering said reservoir opening and sealed to said lip around the totality of said periphery of said reservoir; and at least a portion of said lip formed as a first support finger, a portion of said support finger disjoined from said lip along at least one elongated slit between said lip and said support finger and a remaining portion of said support finger joined to said lip along a connecting area between said support finger and said lip, said support finger bendable with respect to said lip about said connecting area so as to locate said support finger at an angle to the plane of said lip.

2. A packaging cup of claim 1 including:

first and second support fingers each formed as an independent portion of said lip;

each of said first and said second support fingers independently bendable at an angle to said plane of said lip; and said first and second support fingers located in positions on said lip in operative association with each other so as to be positioned on the same side of said cup when said respective support fingers are located at respective angles to the plane of said lip.

3. A packaging cup of claim 1 including:

first and second support fingers each formed as an independent portion of said lip;

each of said first and said second support fingers independently bendable at an angle to said plane of said lip; and said first and second support fingers located in positions on said lip in operative association with each other so as to be positioned in a plane when said respective support fingers are located at respective angles to the plane of said lip and wherein said plane of said support finger intercepts the plane of said lip.

4. A packaging cup of claim 1 wherein:

the outside periphery of said lip is quadrilateral in shape and said slit is essentially parallel to one of the sides of said quadrilateral.

5. A packaging cup of claim 1 including:

first and second support fingers each formed as a portion of said lip;

a portion of said first support finger disjoined from said lip by a first slit and a remaining portion of said first support finger joined to said lip along a connecting area between said first support finger and said lip;

a portion of said second support finger disjoined from said lip by a second slit and a remaining portion of said second support finger joined to said lip along a connecting area between said second support finger and said lip; and each of said first and said second support finger bendable with respect to said lip about the respective connecting areas between said respective first and second support fingers and said lip.

6. A packaging cup of claim 5 wherein:

said first and said second slits are independent colinear slits.

7. A packaging cup of claim 5 wherein:

said first and said second slits are independent parallel slits.

8. A packaging cup of claim 5 wherein:

said first and said second slits are independent coarcuate slits.

9. A packaging cup of claim 5 wherein:

said first and second slits together comprise a single elongated slit and further including a further slit located perpendicular to said single elongated slit and intersecting said single elongated slit to divide said single elongated slit at the point of intersection into said first and said second slits.

10. A packaging cup of claim 5 wherein:

the outside periphery of said lip is quadrilateral in shape and said first and said second slits are essentially parallel to one of the sides of said quadrilateral.

11. A packaging cup of claim 5 wherein:

the outside periphery of said lip is circular in shape and said first and said second slits are arcs of a radius which is smaller than the radius of said circular shaped lip.

12. A hanging packaging cup which comprises:

a resilient body having a product reservoir and a lip integrally formed together, said reservoir having a periphery surrounding an opening into said reservoir and said lip formed as a continuous essentially planar flange extending from the periphery of said reservoir, said lip having an underside and an upperside, said reservoir extending beyond said underside of said lip;

lid means for sealing and reservoir, said lid means covering said reservoir opening and sealed to said upperside of said lip around the totality of said periphery of said reservoir;

support means for supporting said cup on an essentially vertical surface having a top, said support means attaching to and extendible from said lip essentially parallel to said reservoir so as to create a gap on said underside of said lip between the exterior of said reservoir and said support means, said cup supportable on said surface by positioning said surface in said gap with the underside of said lip resting on the top of said surface and with surface interleaved between said support means and said reservoir; and said support means including first and second support fingers each integrally formed as a part of said lip and defined in said lip by separation means for separating portions of each of said first and said second support fingers from said lip, remaining connecting portions of each of said first and said second support fingers connected to said lip with each of said first and said second support fingers bendable with respect to said lip about said connecting portions.

13. A packaging cup of claim 12 wherein:

said separating means includes at least first and second slits in said lip, said first slit disjoining a portion of said first support finger from the remainder of said lip and said second slit disjoining a portion of said second support finger from the remainder of said lip.

14. A packaging cup of claim 12 wherein:

said support means includes first and second support fingers each integrally formed as a part of said lip and defined in said lip by slits formed in said lip which separate portions of each of said first and said second support fingers from said lip, remaining connecting portions of each of said first and said second support fingers connected to said lip with each of said first and said second support fingers bendable with respect to said lip about said connecting portions to position each of said first and said second support fingers out of the plane of said lip below the underside of said lip.

15. A process of forming a packaging cup which is capable of being suspended from a further product container which comprises:

forming said packaging cup to include a product reservoir and a planar cup lip which extends outward in a plane around the totality of the periphery of the reservoir;

filling the reservoir with a product;

overlaying a lid on said cup to completely cover the product reservoir and to extend over the cup lip;

sealing said lid to said cup lip;

cutting at least one slit in said cup lip and cup lid sealed to said cup lip, said slit extending from a position on the periphery of said cup lip along a line spaced from and following the configuration of the periphery of said cup lip, and slit defining a support finger formed in said lip of said cup which is capable of bending out of the plane of said lip.

16. The process of claim 15 including:

cutting at least two slits in said cup lip and cup lid sealed to said cup lip, each of said slits independently extending from a position on the periphery of said cup lip along a line spaced from and following the configuration of the periphery of said cup lip, each of said slits defining a support finger formed in said lip of said cup which is capable of bending out of the plane of said lip.

17. A hanging packaging cup which comprises:

a resilient body having a product reservoir and a lip integrally formed together, said reservoir having a periphery surrounding an opening into said reservoir and said lip formed as a continuous essentially planar flange extending from the periphery of said reservoir, said lip having an underside and an upperside, said reservoir extending beyond said underside of said lip;

lid means for sealing said reservoir, said lid means covering said reservoir opening and sealed to said upperside of said lip around the totality of said periphery of said reservoir;

at least one slit formed in said cup lip;

said slit extending at least through said cup lip between said upperside of said lip and said underside of said lip;

said slit further extending from a position on the periphery of said cup lip along a line spaced from and following the configuration of the periphery of said cup lip; and said slit defining a support finger formed in said lip of said cup; said support finger being bendable out of the plane of said lip.

18. A cup of claim 17 including:

at least two slits in said cup lip;

each of said slits independently extending along a line spaced from and following the configuration of a portion of the periphery of said cup lip; and each of said slits at least in part defining a support finger formed in said lip of said cup which is bendable out of the plane of said lip.

19. A cup of claim 18 wherein:

said lip is quadrilateral in shape; and each of said slits is spaced from and extends parallel to an edge of said quadrilateral shaped lip.

* * * * *

UNITED STATES PATENT AND TRADEMARK OFFICE

CERTIFICATE OF CORRECTION

PATENT NO. : 4,854,466

DATED : AUGUST 8, 1989

INVENTOR(S) : WILLIAM A. LANE, JR.

It is certified that error appears in the above-identified patent and that said Letters Patent is hereby corrected as shown below:

Column 4, line 50, "of a" should be --on a--

Column 5, line 44, "instances" should be --instance--.

Column 6, line 3, "shaped" should be --shape--.

Column 6, line 3, "acheived" should be --achieved--.

Column 6, line 66, "cups. Alternately" should be --cups, alternately--

Column 7, line 18, "hold it" should be --hold its--.

Column 7, line 19, "shaped" should be --shape--.

Column 7, line 21, "shaped" should be --shape--.

Column 9, line 6, insert --said-- between "with" and "surface"

Column 10, line 3, "and" should be --said--.

Signed and Sealed this

Twenty-fifth Day of December, 1990

*Attest:*

HARRY F. MANBECK, JR.

*Attesting Officer*

*Commissioner of Patents and Trademarks*